United States Patent [19]

Vitalo

[11] 3,957,267

[45] May 18, 1976

[54] SAFETY RESTRAINER FOR BAT

[76] Inventor: Angelo R. Vitalo, 1306 Barksdale Road, Newark, Del. 19711

[22] Filed: Aug. 9, 1974

[21] Appl. No.: 496,290

[52] U.S. Cl. ..... 273/26 C; 273/166

[51] Int. Cl.[2] ..... A63B 69/40

[58] Field of Search ..... 273/54 R, 35 R, 26 C, 273/28, 165, 166, 75, 72 R; 272/82; 2/161 A

[56] References Cited

UNITED STATES PATENTS

| | | | |
|---|---|---|---|
| 1,681,389 | 8/1928 | Blake | 273/166 |
| 2,319,390 | 5/1943 | Dantolan | 273/166 |
| 2,496,808 | 2/1950 | Moore | 273/166 |
| 2,522,344 | 9/1950 | Garmin | 2/161 A |
| 2,858,542 | 11/1958 | Ogg | 2/161 A |
| 3,408,657 | 11/1968 | Gallagher | 273/166 |
| 3,497,218 | 2/1970 | Johnston | 273/26 C |
| 3,606,343 | 9/1971 | Lemon | 273/166 |

*Primary Examiner*—Richard J. Apley
*Assistant Examiner*—T. Brown
*Attorney, Agent, or Firm*—Connolly and Hutz

[57] ABSTRACT

Baseball bat or the like can be kept from being unintentionally thrown from batters hand by a restrainer that can be fitted around the wrist of a batter and has loops looping around adjacent portions of bat. Quick-release fastening means holds loops around the bat. The restrainer is made up of a wrist loop and a pair of elongated loops, each elongated loop having one of its ends attached transversely to the wrist loop and having its other end attached by the quick-release fastener to the wrist loop. When in operating condition, the wrist loop is attached to the wrist of a user, a bat is gripped by the hand wearing the wrist loop, the pair of loops are looped around the bat, one loop on one side of the hand and the other loop on the other side of the hand, and the quick-release fastener is fastened to the wrist loop to secure the bat in the hand until the wrist carrying the restrainer brushes the quick-release fastener against an object, such as a batter's body, to operate the quick-release for freeing the bat from the hand.

6 Claims, 5 Drawing Figures

SAFETY RESTRAINER FOR BAT

The present invention relates to the use of a bat, as in batting balls in the game of baseball.

Among the objects of the present invention is the provision of a novel restrainer that keeps the bat from being unintentionally thrown from the batter's hands when batting a ball. This reduces the changes of injuring anyone nearby by a thrown bat, particularly during a hard swing at a ball.

The foregoing as well as other objects of the present invention will be more fully understood from the following description of several of its exemplifications, reference being made to the accompanying drawings wherein.

According to the present invention, a quick-release bat restrainer comprises a cuff for securing around a wrist, the cuff carrying two loops of flexible restraining material having lengths such that when a bat is held in the hand to which the cuff is secured, both loops loop around and loosely engage the bat alongside said hand, one loop looping around the bat on one side of the hand, and the other looping around the bat on the other side of the hand, and quick-release fastening means for one end of each loop for releasably fastening them to the cuff and for quick disengagement by brushing the fastening means against an object.

Each of the two loops can extend from one side to the other of the wrist to which the cuff is secured, and the quick-release means connects the cuff to the loop ends on one side of the wrist. The cuff can also have quick-release fastening means for releasably securing it around a wrist.

Figure 1:
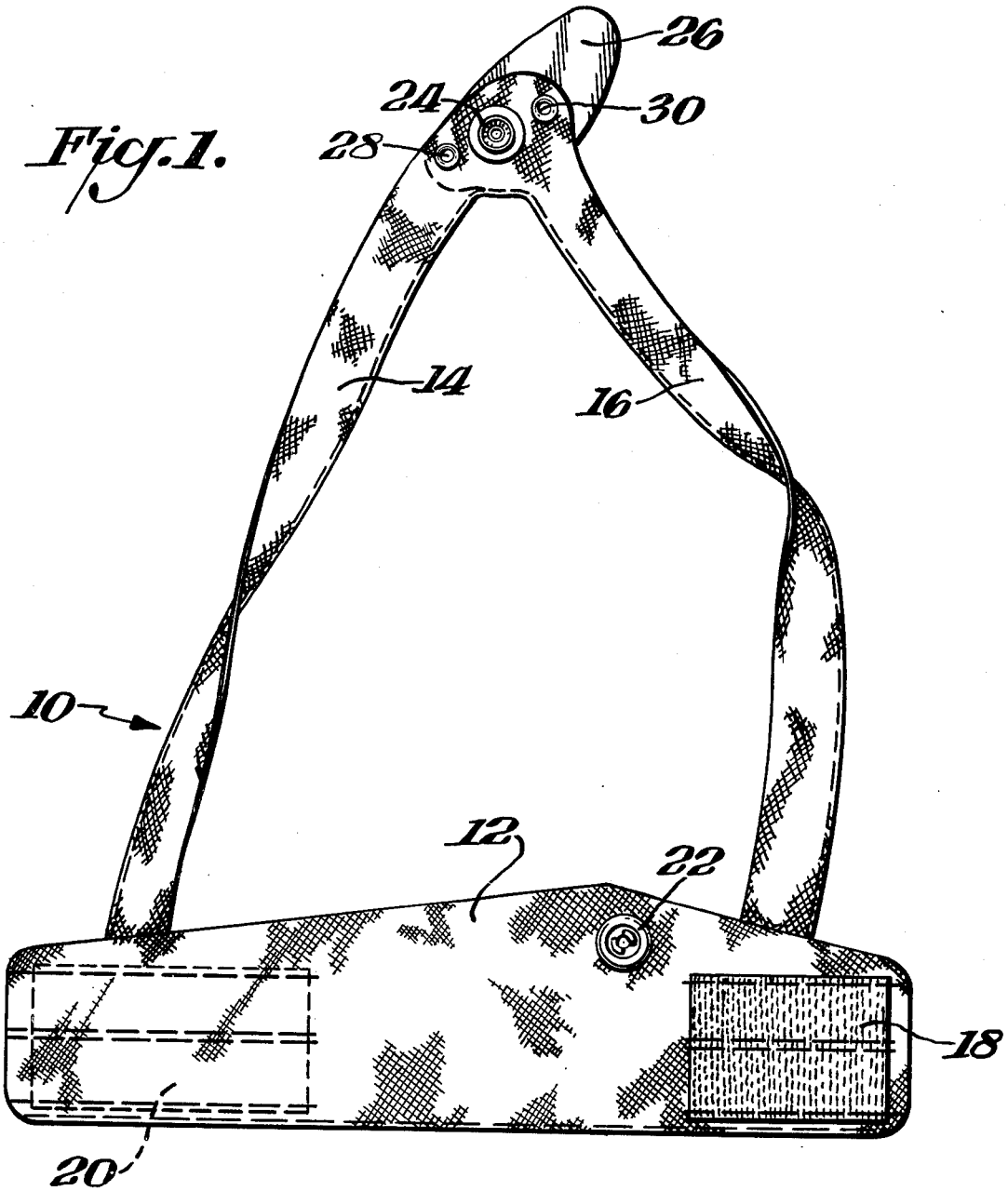
FIG. 1 is a view of a bat restrainer pursuant to the present invention.

Turning now to the drawings, FIG. 1 shows a bat restrainer 10 according to the present invention, having a cuff 12 and two loops 14,16. The cuff is dimensioned to fit around the batter's wrist and is shown as having securing means 18,20 sewn adjacent its opposite ends so that it can encircle a wrist and be secured there by interengagement of the two securing means. These securing means are of the type described in U.S. Pat. Nos. 2,717,437, 2,933,797, 3,083,737, 3,009,235, 3,147,528 and 3,154,837, commonly called "Velcro," one securing means such as 20 having a dense collection of textile loops projecting from the cuff, and the other 18 having a series of small flexible hooks bent from plastic filaments so arranged that the hooks engage loops when the two securing means are brought together face-to-face and thus securely hold the ends of the cuff together. However, a determined pull on a cuff end, particularly in the direction that lifts its fastening means from the opposing fastening means, will pull the hooks away from the loops they engage, and thus permit a quick release of the cuff.

The cuff also has secured to it a button-type snap fastener 22 with a mating snap fastener 24 secured to the distal ends of loops 14,16. Also carried by the distal ends which in the illustration are joined together, is a tab 26 of stiff material such as a disc of high density polyethylene plastic. The remainder of the bat restrainer can be entirely of textile construction. Eyelet-type rivets 28,30 are shown as attaching the tab 26 to the loops. Instead of securing the tab in this way, the textile material of the loops can be extended and sewn to or around a stiff insert, or can merely be stiffened by dipping in a solution of a plastic such as polyvinyl chloride in a volatile solvent such as acetone, after which the solvent can be volatilized off leaving polyvinyl chloride impregnating and stiffening the textile.

Figure 2:
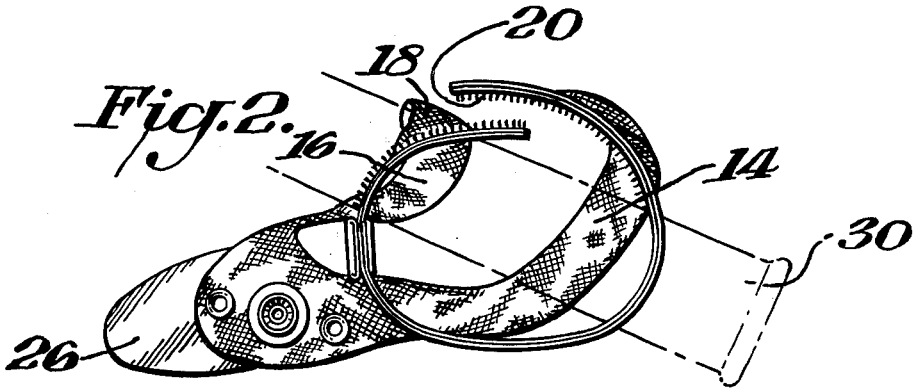
FIG. 2 is a view of the bat restrainer of FIG. 1 as it is placed in position for encircling a wrist.

The loops 14,16 are arranged so that when the cuff is worn on a wrist, they extend from the cuff beyond the wearer's fingers but can be folded back as by grasping the tab 26 with the other hand to bring snap fastener 24 into mating engagement with snap fastener 22. Before folding them back in this way, a bat, shown by dashed lines 30 in FIG. 2, is placed in the hand that wears the cuff. After the loops are folded back and snap fastened, they each loop around the bat and loosely keep it from falling out of the hand in which it is held, even when the fingers of that hand are opened.

Figure 3:
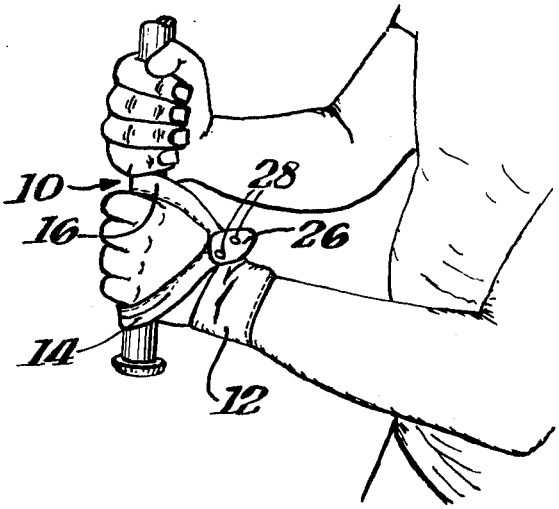
FIG. 3 is a view showing the restrainer of FIG. 1 worn by a batter as he holds a bat.

FIG. 3 shows the resulting arrangement and it will be noted that loop 14 is looped around the bat just beyond the little finger of the wrist on which the restrainer is worn, while loop 16 is looped around the bat at the other side of the hand adjacent the thumb. The illustration of FIG. 3 is that of a right-handed batter, where the bat is principally carried in the fingers of the left hand and the bat restrainer is fitted around the wrist of the left hand. The right hand of the batter is generally placed on the bat just above the left hand, as illustrated in FIG. 3 and the bat swung against the ball with both hands. At the completion of such a swing, the grip of the right hand on the bat is generally released so that the swing is completed with the bat only held in the left hand, and with the left hand generally moving in a relatively low position.

Figure 4:
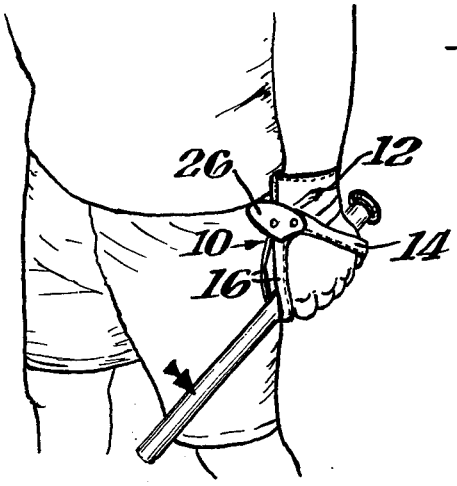
FIGS. 4 and 5 are views similar to FIG. 3 of the quick-release manipulation that releases the bat from the restrainer.

FIG. 4 illustrates the bat hand and restrainer positions at that point. Until that point is reached, the restraining action of the loops keeps the bat from flying out of the wearer's left hand.

Figure 5:
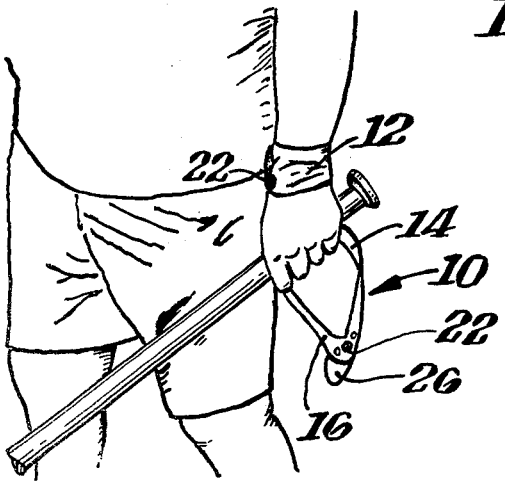

In the event the batter's swing successfully hits the ball, it then becomes important for the batter to release the bat and run to first base. At that point it is no trouble for the batter to move his left hand closer to his body, and in this way to brush tab 26 against his clothing. This lifts snap fastener 24 out of engagement with snap fastener 22 and permits the loops to then unfold into the position shown in FIG. 5. Opening the fingers of the left hand will then permit the bat to drop out of the hand so that the batter is not encumbered by it when running toward base. It will be noted, however, that until the tab is deliberately actuated to unsnap the loops, and thus throughout the entire normal swing of the batter, there is no way for the bat to be released or to slip out from the batter's hands.

For left-handed batters, the bat restrainer of the present invention is preferably worn on the wrist of the right hand and thus can be made as a mirror image of the restrainer shown on FIG. 1. A bat restrainer can be made to fit both hands, in which event it is desirable to have two snap fastener elements 22, one near each end of the cuff, with the tab 26 shaped to have an additional extension for use when worn on the other hand. Such an additional extension is shown in dashed lines in FIG. 1 at 32. With this kind of ambidextrous construction, the restrainer is worn in either hand so that the side where the loops 14,16 emerge from the cuff is on the inside or palm side of the wrist so that they extend out along the fingers and then around the bat and fold back to be snapped against a part of the cuff on the back side of the wrist adjacent the thumb.

Instead of having the loops 14,16 permanently joined to the cuff 12, they can have their roots merely connected to each other as their distal ends are, with the joined root ends also holding the snap fastener that mates with snap fastener 24. An opening can then be provided in the cuff wide enough to permit both snap fasteners to fit through and thus engage each other as well as have the loops held by the cuff. Then upon opening of the snap fastener, not only will the distal ends of the loops fall away but the root ends will also be unsnapped in the same operation and both loops in their entirety can then be pulled out or can fall away from the cuff.

The cuff securing means 18,20 can also readily be pulled apart whether or not the loops are made completely removable so that all portions of the restrainer can be readily pulled off the wrist and discarded when a batter is starting to run to the base. The loop-and-flexible-hook combination of securing means 18,20 is particularly desirable since it securely holds the cuff on wrists of widely varying sizes.

However, the fastening means 18,20 can be replaced by snaps if desired, in which event a plurality of such mating snaps is preferably provided at either or both ends of the cuff so that it will then also fit wrists of widely varying sizes.

The cuff need not have the specific shape shown at 12 but can be rectangular or have any other shape desired. Also, instead of making it of textile, it can be made of plastic sheeting, as can the loops.

Obviously many modifications and variations of the present invention are possible in the light of the above teachings. It is therefore to be understood that within the scope of the appended claims the invention may be practiced otherwise than as specifically described.

What is claimed:

1. A quick-release bat restrainer comprising a cuff for securing around a wrist, the cuff carrying two elongated loop members of flexible restraining material, each loop member having each of its ends secured by securing means to said cuff, said loop members having lengths such that when a bat is held in the hand to which the cuff is secured, both loop members loop around and loosely engage the bat alongside said hand, one loop looping around the bat on one side of the hand, and the other looping around the bat on the other side of the hand, and said securing means at one end of each loop member being quick-release fastening means for releasably fastening them to the cuff and for quick disengagement by brushing the fastening means against an object.

2. The combination of claim 1 in which each of the two loops extends from one side to the other of the wrist to which the cuff is secured, and the quick-release means connects the cuff to the loop ends on one side of the wrist.

3. The combination of claim 1 in which the cuff is an elongated flexible member with two ends and quick-release fastening means for securing its two ends together around a wrist.

4. The combination of claim 1 in which the quick-release means includes snap fastening elements and a tab that unsnaps the snap fastening elements when the tab is brushed against the body of the wearer.

5. The combination of claim 3 in which the quick-release cuff fastening means is a loop-and-flexible-hook means that pushes into fastening engagement, and pulls apart.

6. The combination of claim 1 in which the quick-release fastening means is located at the portion of the cuff adjacent the thumb of the hand on which the cuff is mounted.

* * * * *